United States Patent [19]

Maeda et al.

[11] Patent Number: 4,943,834

[45] Date of Patent: Jul. 24, 1990

[54] IMAGE FORMING APPARATUS CAPABLE OF DETECTING, ANALYZING AND DISPLAYING AN ORIGINALS SPECTROSCOPIC COLOR DATA

[75] Inventors: Yasutaka Maeda, Nara; Tsuyochi Miyamoto, Osaka; Yukihiko Ueno, Osaka; Hiromi Washio, Osaka, all of Japan

[73] Assignee: Sharp Kabushiki Kaisha, Osaka, Japan

[21] Appl. No.: 239,446

[22] Filed: Sep. 1, 1988

[30] Foreign Application Priority Data

Sep. 30, 1987 [JP] Japan ..... 62-248971
Sep. 30, 1987 [JP] Japan ..... 62-248972

[51] Int. Cl.[5] ..... G03G 15/01; G03G 21/00

[52] U.S. Cl. ..... 355/327; 355/204; 356/406; 358/80

[58] Field of Search ..... 355/204, 245, 246, 327, 355/326, 38; 356/406, 407, 416, 419, 425; 346/157; 358/75, 80

[56] References Cited

U.S. PATENT DOCUMENTS

| | | | |
|---|---|---|---|
| 4,564,287 | 1/1986 | Suzuki et al. | 355/246 |
| 4,653,014 | 3/1987 | Mikami et al. | 356/406 X |
| 4,742,372 | 5/1988 | Takahashi | 355/246 |
| 4,830,501 | 5/1989 | Terashita | 355/204 X |
| 4,834,541 | 5/1989 | Yamaba | 356/406 |

FOREIGN PATENT DOCUMENTS

| | | | |
|---|---|---|---|
| 0140961 | 6/1986 | Japan | 355/245 |
| 0249166 | 10/1988 | Japan | 355/246 |

*Primary Examiner*—A. T. Grimley
*Assistant Examiner*—William J. Royer
*Attorney, Agent, or Firm*—Flehr, Hohbach, Test, Albritton & Herbert

[57] ABSTRACT

A color copier includes an optical sensor unit and analyzes colors of reflected light from an original to be copied by detecting spectroscopic color data of the reflected light. Amounts of toner of different colors for forming a color image are determined according to such detected spectroscopic color data.

7 Claims, 8 Drawing Sheets

IMAGE FORMING APPARATUS CAPABLE OF DETECTING, ANALYZING AND DISPLAYING AN ORIGINALS SPECTROSCOPIC COLOR DATA

BACKGROUND OF THE INVENTION

This invention relates to a color copier for forming a latent image by color-analyzed light reflected from an original to be copied and forming a toner image by using toner of complementary colors of the color-analyzed light such that color corrections can be effected on the image to be produced.

With the recent development in electrophotography, color copiers capable of forming full-color images are coming to be developed. A color copier is typically comprised of color filters for spectroscopically separating a reflected beam of light from an original into blue, green and red beams and three developing devices having respectively toner of their complimentary colors, that is, yellow, magenta and cyanic and forms a full-color image by three image-forming processes. In other words, a yellow toner image is formed by blue light, a magenta toner image by green light, a cyanic toner image by red light and these three toner images are superposed on a single sheet of paper to form a full-color imaqe.

In the case of an original which is particularly colored, however, exposure, charging voltage of the photoreceptor and/or bias voltage for the developing device must be adjusted every time a toner image is formed such that this particular color can be emphasized. If the original has a strongly reddish image, for example, the cyanic toner image must be made lighter such that red can be emphasized in the copy and for this purpose, exposure must be increased, charging voltage of the photoreceptor must be set close to zero and/or bias voltage of the developing device must be set close to the voltage of the photoreceptor when the cyanic toner image is formed. Such adjustments have conventionally been done manually by the operator. In other words, the operator had to test several times by varying exposure, etc. to determine a desired setting. It is not only time-consuming but also wasteful.

SUMMARY OF THE INVENTION

It is therefore an object of the present invention in view of the above to provide a color copier with which anybody can easily form a color image of high quality.

It is another object of the present invention to provide a color copier which detects spectroscopic color data of an original to adjust exposure, etc. on the basis of such color data.

The above and other objects of the present invention are achieved by providing a color copier of the type which carries out color analysis of reflected light from an original and forms a color toner image by using toner of complementary colors, characterized as having optical sensors for obtaining spectroscopic color data of the original.

The present invention also discloses a color copier further provided with means for adjusting the amount of toner of different colors forming an image by controlling exposure, charging voltage of the photoreceptor, etc. according to the spectroscopic color data obtained by the optical sensors.

With a color copier embodying the present invention, reflected light from an original to be copied is spectroscopically separated into color components and their spectroscopic color data are separately detected by the optical sensors. If the reflected light is separated into blue, green and red light and if the original is reddish, for example, the sensors obtain data which indicate that red light is stronger than light of other colors. A good color image is obtained if exposure, charging voltage of the photoreceptor and/or biased voltage of the developing device is set according to such detected data.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
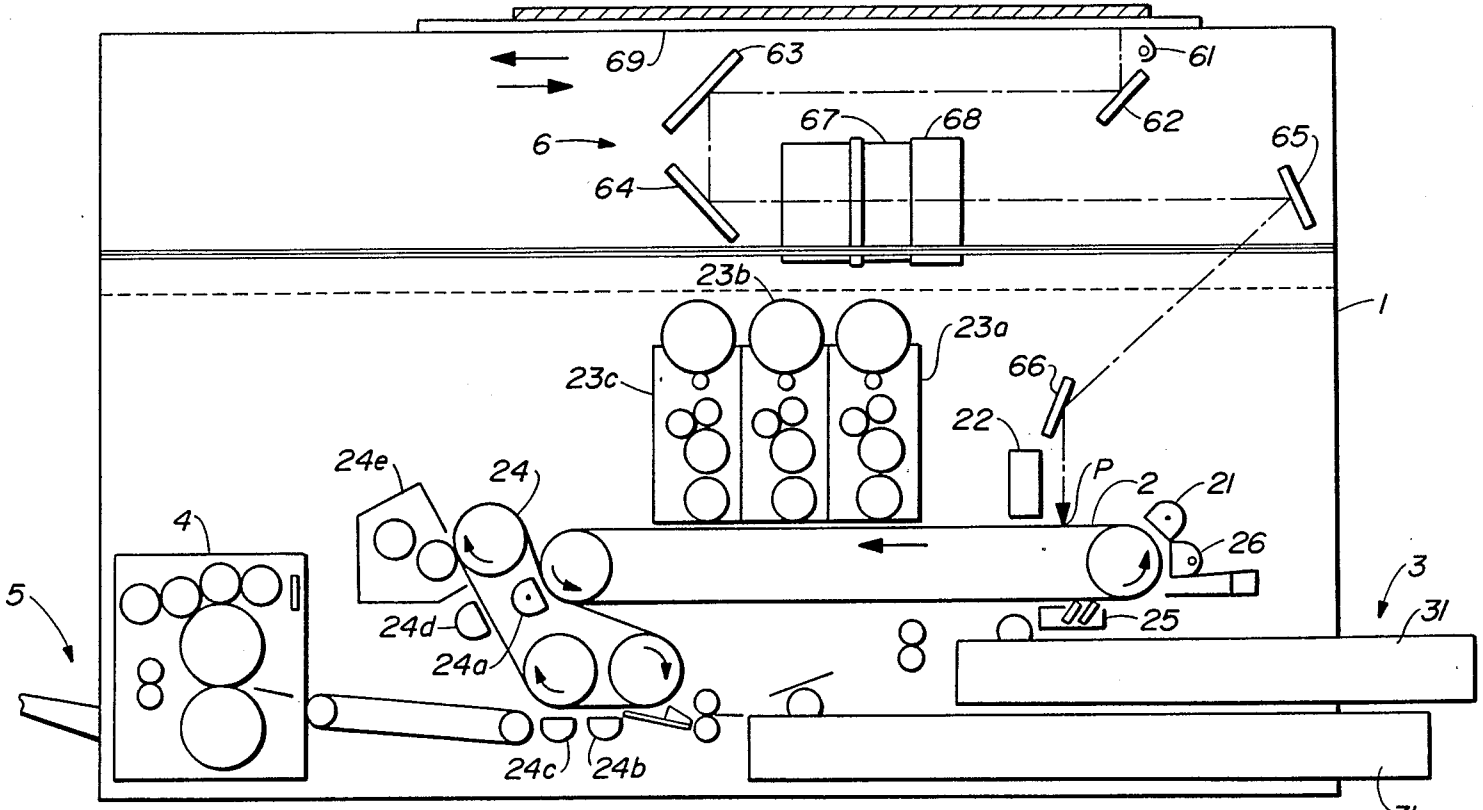
FIG. 1 is a schematic front sectional view of a color copier embodying the present invention.

With reference to FIG. 1 which schematically shows the structure of a color copier embodying the present invention, a photoreceptor 2 in the form of an endless belt is disposed near the center of its housing 1. The photoreceptor 2 is surrounded by a primary charger 21, a blanking lamp unit 22, developing devices **23*a*, 23*b* and 23*c*, a transfer medium 24, a cleaning device 25 and a charge removing lamp 26 in this order. The developing devices 23*a*, 23*b* and 23*c*** are filled respectively with yellow, magenta and cyanic toner.

The transfer medium 24 is in contact with the photoreceptor 2 and a first transfer charger **24*a* is disposed where they are in contact. The transfer medium 24 is surrounded also by a second transfer charger 24*b*, a paper removing charger 24*c*, a charge removing charger 24*d* and a cleaning device 24*e*** in this order.

In the right-hand side of the housing 1 is a paper supplying section 3 which includes paper cassettes 31. In the left-hand side of the housing 1 are a fixing device 4 and a discharge section 5. The upper part of the housing 1 contains an optical system 6 which includes a light source 61, mirrors 62–66, a lens 67 and a color filter unit 68 and serves to scan an original placed on a document table 69 and to direct reflected light therefrom to an exposure point P on the photoreceptor 2. The color filter unit 68 is controllable such that only blue, green or red light can be transmitted therethrough.

Copying process starts with the optical system 6 scanning a color original. The color filter unit 68 allows only the blue light to pass through and be made incident on the photoreceptor 2 at the exposure point P. A latent image carrying blue data is thereby formed and yellow toner is attached thereon by the developing device 23*a* filled with yellow toner. This yellow toner image is transferred onto the transfer medium 24 by the first charger 24*a*. The optical system 6 then scans the color original again to form another latent image on the photoreceptor 2 by allowing only the green light to pass through the color filter unit 68 and magenta toner is attached to this latent image to form another toner image. This magenta toner image is formed at the same image position as the yellow toner image previously transferred onto the transfer medium 24. Still thereafter, the optical system 6 scans the original by allowing only the red light to pass through the color filter unit 68 to thereby form still another latent image on the photoreceptor 2. Cyanic toner is attached to this latent image to form a cyanic toner image which is then superposed on the yellow and magenta images on the transfer medium 24.

The toner image in three colors thus formed on the transfer medium 24 is transferred onto a transfer sheet of paper supplied from the paper supplying section 3. The transferred three-color image is fixed by the fixing device 4 and the transfer sheet with a full-color image is discharged into the discharge section 5.

Figure 2:
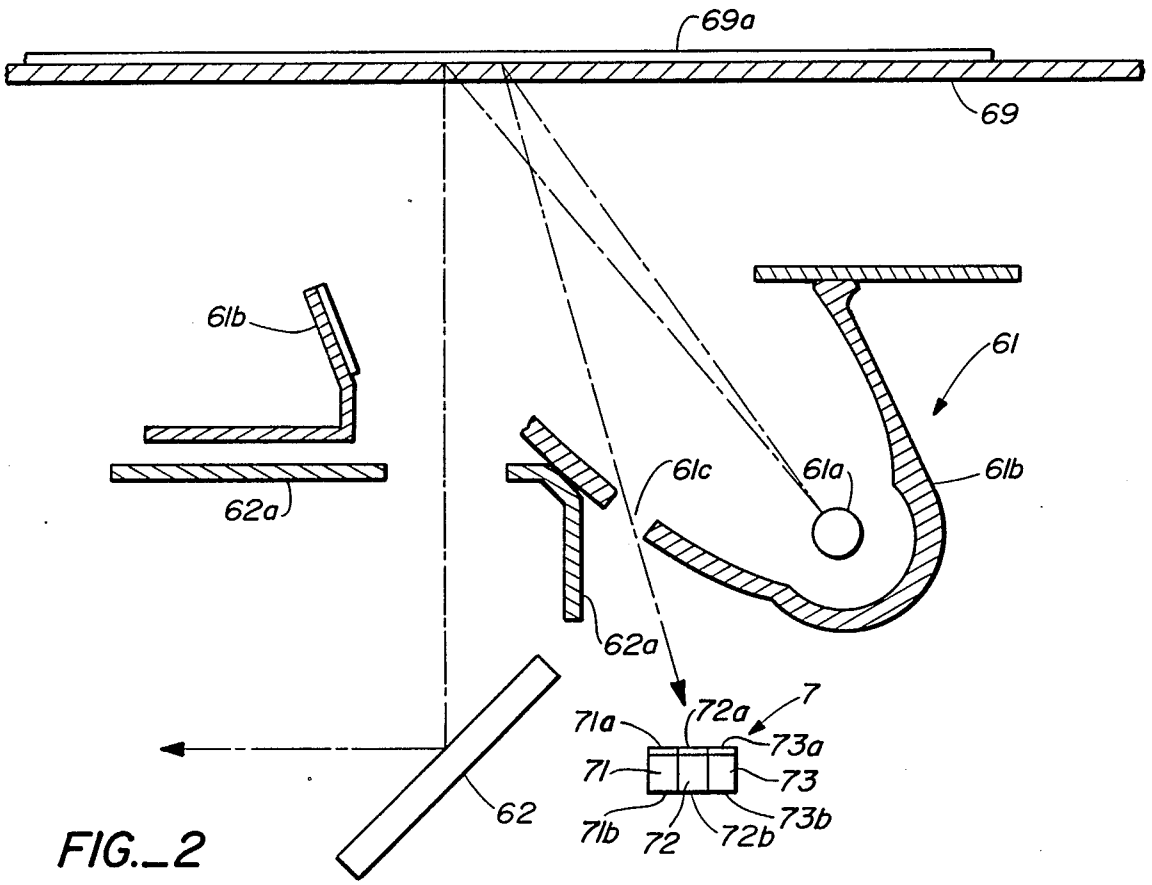
FIG. 2 is an enlarged schematic front sectional view of a section of the color copier of FIG. 1.

The vicinity of the light source 61 is shown further in detail in FIG. 2. The light source 61, which serves to scan an original 69*a* on the document table 69, includes a lamp unit 61*a* and a reflector 61*b* for directing the light from the lamp unit 61*a* generally towards the original 69*a* and also for preventing stray beams from escaping outward, for example, towards the mirror 62 which is also partially protected by its own reflector 62*a*. An optical sensor unit 7 is disposed below the light source 61 and the reflector 61*b* is provided with a slit 61*c* such that a part of the reflected light from the original 69*a* reaches the optical sensor unit 7 through this slit 61*c*. The optical sensor unit 7 is comprised of three spectroscopic sensors 71, 72 and 73 each provided with a blue, green and red transmissive filter 71*a*, 72*a* and 73*a*, respectively, as well as a photometer 71*b*, 72*b* and 73*b* for measuring the received quantity of light. The light source 61, the mirror 62 and the optical sensor unit 7 are unitized and moved together when the original 69*a* is scanned.

Figure 3:
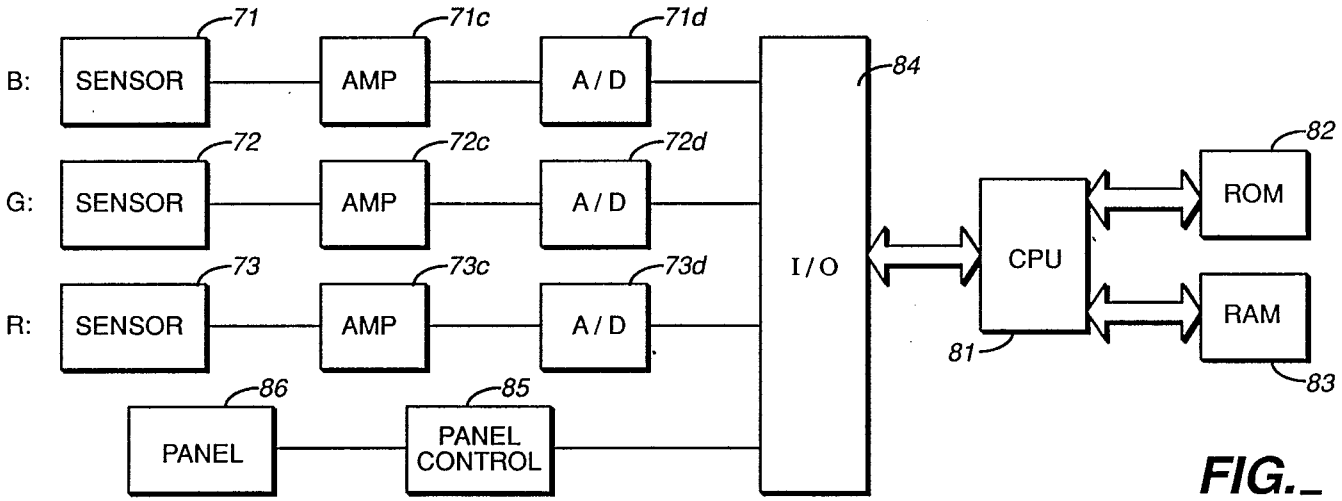
FIG. 3 is a block diagram of the copier of FIGS. 1 and 2.

With reference next to FIG. 3, numeral 81 indicates a central processing unit (CPU) which controls the entire operation of the copier according to a program stored in a read-only memory (ROM) 82, numeral 83 indicates a random-access memory (RAM) which is used as a work area for the execution of this program. Data received by the aforementioned spectroscopic sensors 71, 72 and 73 are amplified by amplifiers (AMP) 71*c*, 72*c* and 73*c* and binary-converted by analog-to-digital convertors (A/D) 71*d*, 72*d* and 73*d*, respectively, and then inputted to the CPU 81 through an I/O interface circuit 84.

Figure 4:
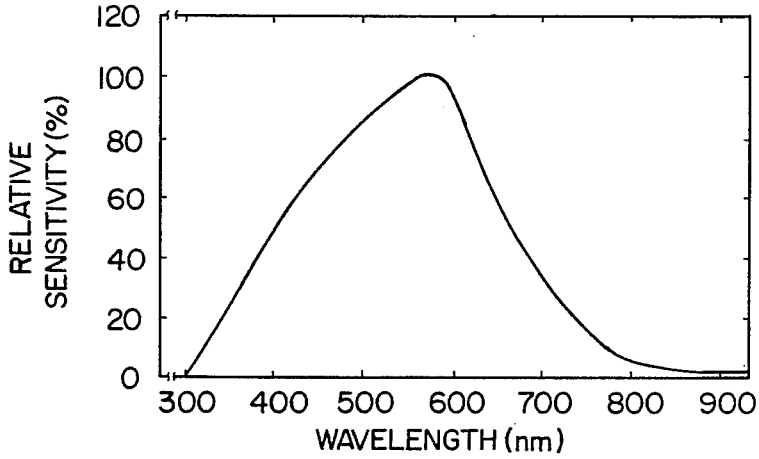
FIG. 4 is a graph showing the sensitivity characteristic of the photometers shown in FIG. 2.
Figure 5:
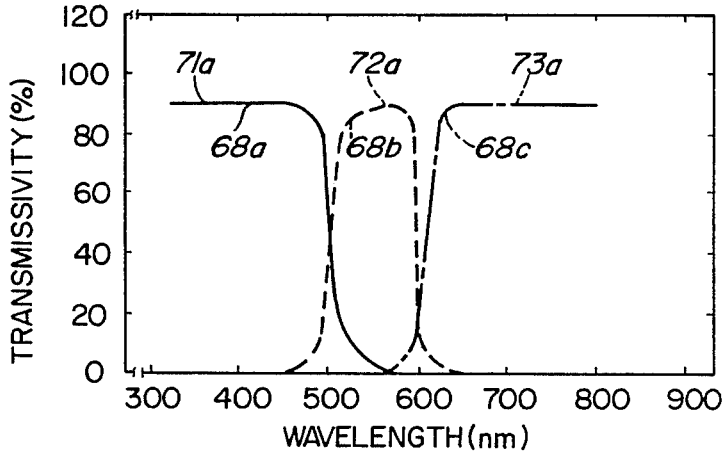
FIG. 5 is a graph showing the transmissivity characteristics of filters.
Figure 6A:
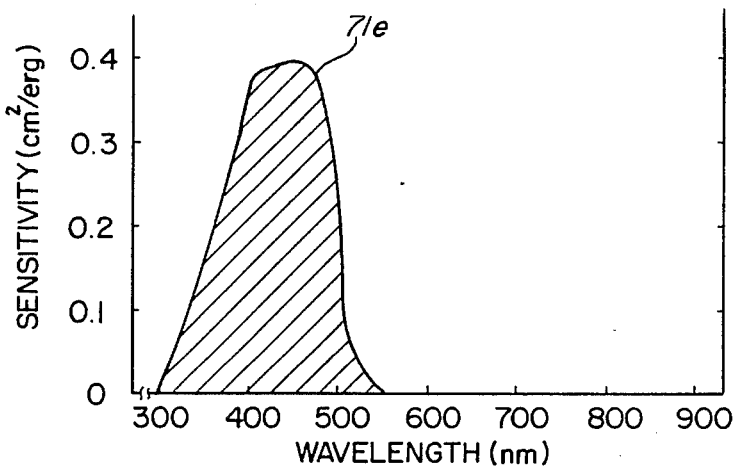
FIG. 6A, 6B and 6C are graphs showing the sensitivity characteristics of the photometers of FIG. 2 with the color filters.
Figure 6B:
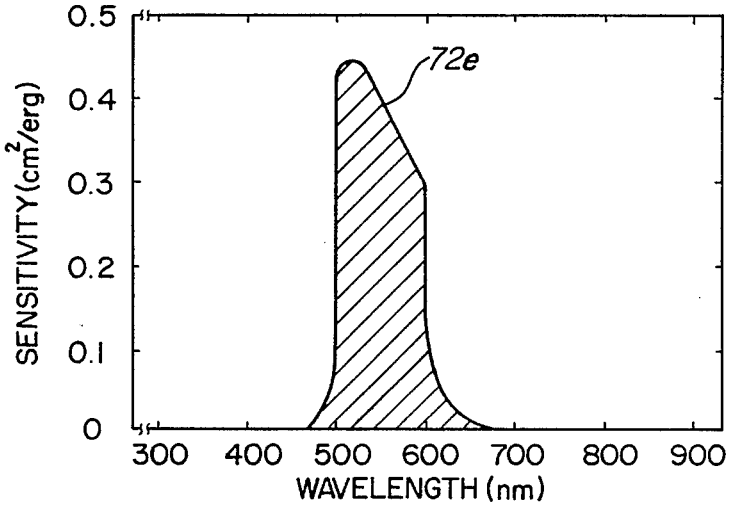
Figure 6C:
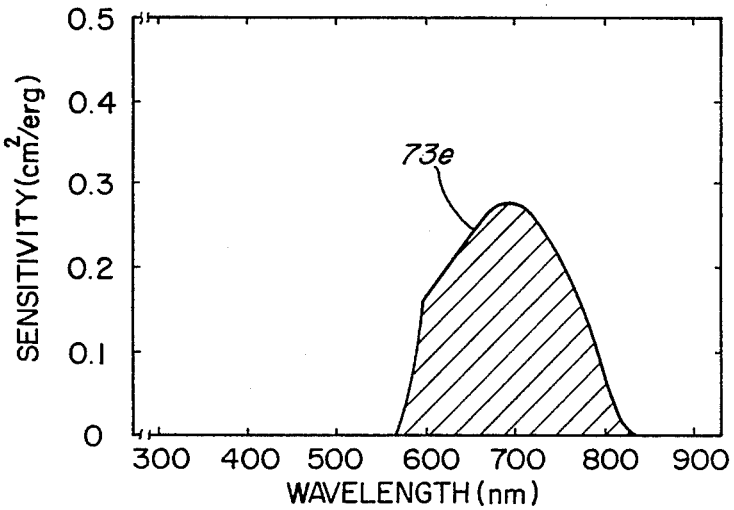
Figure 7:
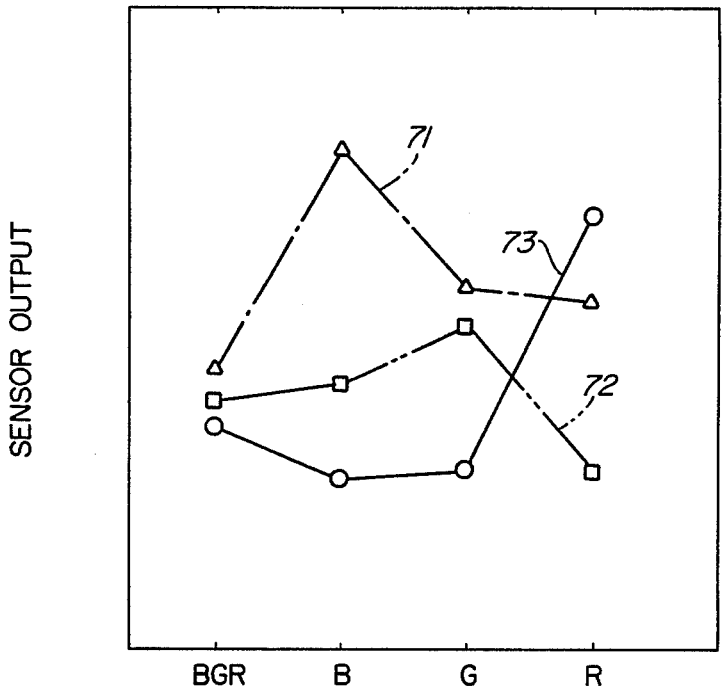
FIG. 7 is a graph showing the output from the optical sensor unit with originals having different color characteristics.

The photometers 71*b*, 72*b* and 73*b* used in the spectroscopic sensors 71, 72 and 73 are sensitive to green but not very sensitive to red. Their sensitivity characteristic is as shown in FIG. 4. The transmissivity characteristics of the filters 71*a*, 72*a* and 73*a*, as well as those of the three color filters 68*a*, 68*b* and 68*c* of the color filter unit 68, are shown in FIG. 5. This means that the sensitivity characteristics of the three spectroscopic sensors 71, 72 and 73 are obtained by multiplying the curve in FIG. 4 with each of the three curves in FIG. 5. They are shown in FIGS. 6A, 6B and 6C respectively for blue, green and red. The ratio of the shaded areas under curves 71*e*, 72*e* and 73*e* in FIGS. 6A, 6B and 6C, respectively, represents the output ratio from the spectroscopic sensors 71, 72 and 73. FIG. 7 shows output levels from the three spectroscopic sensors 71, 72 and 73 received by the CPU 81 from an original with blue, green and red colors nearly equally balanced (indicated as BGR), a bluish original (indicated as B), a greenish original (indicated as G) and reddish original (indicated as R). The amplifiers 71*c*, 72*c* and 73*c* are intended to be so adjusted that the output ratio becomes nearly 1:1:1.

When the CPU 81 receives input data of the type shown in FIG. 7 from the spectroscopic sensors 71, 72 and 73, it interprets the color characteristics of the scanned original on the basis thereof and outputs interpreted results through the I/0 interface circuit 84 to a panel controller 85 which serves to display the received information on a control panel 86. Thus, the operator has only to scan the original once to have its color characteristics displayed on the control panel 86 and can form a high-quality color image by setting the exposure, the surface voltage of the photoreceptor and/or the bias voltage for the developing device accordingly.

The foregoing description of a preferred embodiment of the invention has been presented for purposes of illustration and description. It is not intended to be exhaustive or to limit the invention to the precise form disclosed and many modifications of the variations are possible in light of the above teaching. For example, the optical sensor unit 7 need not be formed unistructurally with the light source 61 and the mirror 62. It may be placed, for example, on the optical path of the reflected light to the photoreceptor 2 or anywhere as long as the color data of the reflected light can be sensed.

Figure 8:
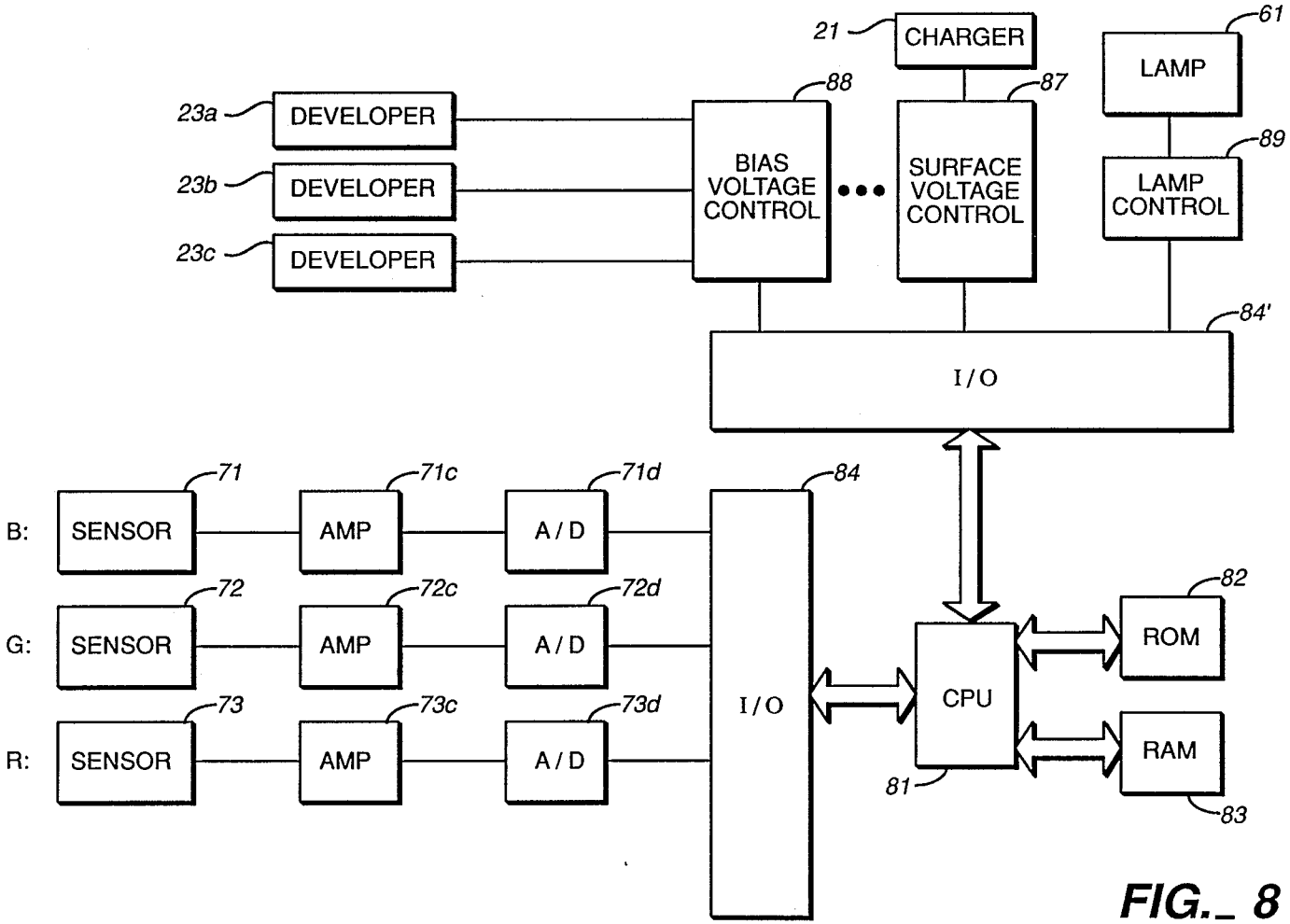
FIG. 8 is a block diagram of another copier embodying the present invention.

As another example, a copier structured as shown in FIGS. 1 and 2 may be so modified that the copying conditions such as exposure can be automatically set according to the result of a preliminary scan. The control system of such an automated copier may be as shown in FIG. 8 such that the CPU 81 according to this embodiment of the present invention may be programmed to output control data through another I/O interface circuit 85 to a lamp controller 86, a photoreceptor surface voltage controller 87, a bias voltage controller 88 for the developing devices (DEV) 23*a*, 23*b* and 23*c*, etc. The ROM 82 and the RAM 83 store a color correction program and data based on the sensitivity characteristic of the photoreceptor 2 as well as those based on spectroscopic data on an original to be copied.

Figure 9:
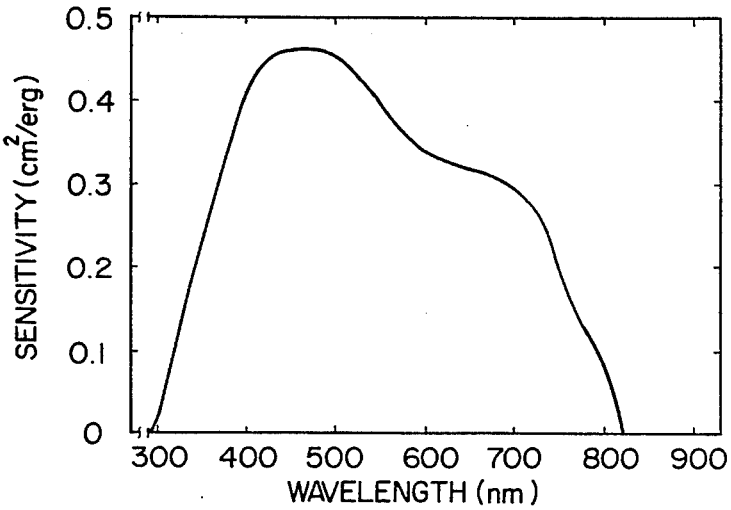
FIG. 9 is a graph showing the sensitivity characteristic of the photoreceptor.
Figure 10A:
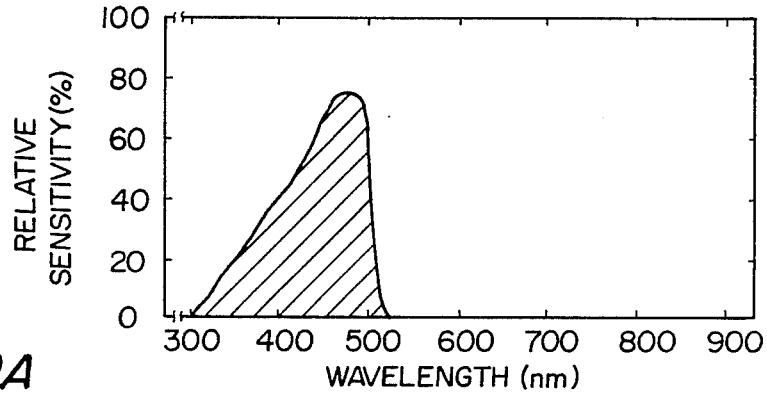
FIGS. 10A, 10B and 10C are graphs showing the sensitivity characteristics of the photoreceptor with the color filters.

More in detail, the sensitivity characteristic of the photoreceptor 2 (shown in FIG. 9) is assumed known. Since the transmissivity characteristics of the filters 68*a*, 68*b* and 68*c* of the color filter unit 68 are as shown in FIG. 5, sensitivity of the photoreceptor 2 when a yellow toner image is formed by using the blue filter is obtained as shown in FIG. 10*a* by multiplying FIG. 9 with the curve 68*a* in FIG. 5. Similarly, sensitivity of the photoreceptor 2 when a magenta or cyanic toner image is formed by using the green or red filter is obtained as shown in FIG. 10*b* or FIG. 10*c* by multiplying FIG. 9 and the curve 68*b* or 68*c* in FIG. 5, respectively.

Figure 10B:
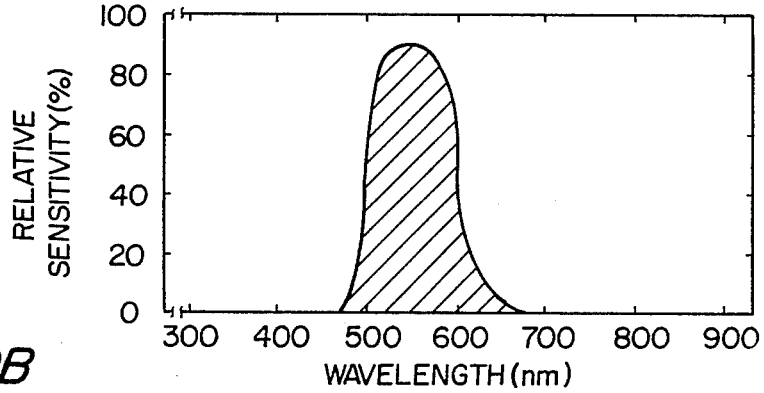
Figure 10C:
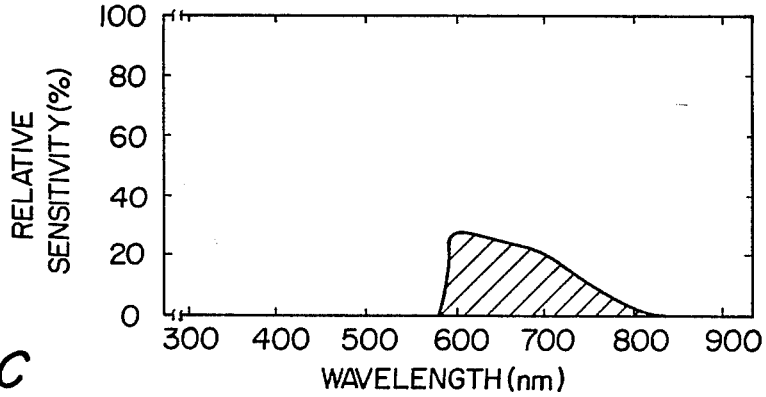

As explained above in connection with the FIGS. 6A, 6B and 6C, the ratio of the shaded areas below the curves shown in FIGS. 10A, 10B and 10C represents the sensitivity ratio of the photoreceptor 2 against the blue, green and red.

The RAM 83 stores data on exposure, surface voltage of the photoreceptor 2 and the bias voltage for development that would make the sensitivity ratio to become 1:1:1 when the original has the same density in blue, green and red. In other words, if a color original with equal density in blue, green and red is copied by setting exposure, surface voltage and bias voltage according to the data stored in the RAM 83, a copy with equal density in blue, green and red can be obtained.

The amplifiers 71c, 72c and 73c are adapted to amplify inputted data such that the input ratio from the spectroscopic sensors 71, 72 and 73 into the CPU 81 will become 1:1:1 when the color corrections described above based on the sensitivity characteristics of the photoreceptor 2 are effected. With the amplifiers 71C, 72C and 73C thus adjusted a copy with a balanced distribution of color densities is produced from a color original with a balanced distribution of color densities.

When a reddish original, for example, is copied with a copier thus adjusted, however, the input ratio from the spectroscopic sensors 71, 72 and 73 is not 1:1:1, the ratio from the sensor 73 for detecting red becoming greater. The CPU 81 is programmed to adjust exposure, surface voltage of the photoreceptor 2 and bias voltage of the developing device according to this inputted ratio. If the input ratio corresponding to red is large, for example, the CPU 81 may increase the exposure, set the surface voltage of the photoreceptor nearly equal to zero or set the bias voltage for the developing device nearly equal to that of the surface voltage of the photoreceptor when the cyanic toner image is formed with red light.

Data related to exposure, surface voltage of the photoreceptor and bias voltage of the developing device thus set are outputted through the I/O interface circuit 85 to the aforementioned lamp controller 86, the photoreceptor surface voltage controller 87 and the bias voltage controller 88 so as to control the exposure, the voltage of the principal charger 21 and the bias voltage of the developing device. Thus, the copier is preliminarily operated to scan a given original to thereby detect its spectroscopic color data and to set conditions of image formation on the basis of this scan. A full-color image formation process is executed thereafter such that a reddish original, for example, yields a reddish copy.

Further modifications and variations of the copier described above by way of FIGS. 1, 2 and 8 are intended to be within the scope of the present invention. For example, the CPU 81 need not necessarily be programmed to set all three copying conditions recited above (exposure, surface voltage and bias voltage). If color corrections are effected by way only of exposure and bias voltage (that is, without controlling the photoreceptor surface voltage), color corrections may be carried out on real time basis. If a halogen lamp is used such that the spectroscopic energy distribution is not uniform, a product not only of the spectroscopic sensitivity of the sensors and that of the filters but also of the spectroscopic energy distribution might be considered. In summary, the present invention makes it possible to set copying conditions by preliminarily obtaining the color data of an original by means of the optical sensors such that a high-quality color copy can be obtained reliably without going through a lengthy trial and error routine.

What is claimed is:

1. In a color copier which includes a photoreceptor, separates colors of reflected light from an original and forms a color toner image by toner of complementary colors, the improvement wherein said color copier comprises optical sensor means for analyzing colors of said reflected light from said original and detecting spectroscopic color data of said reflected light, a control panel, and control means for causing said detected spectroscopic color data to be display on said control panel and operating said color copier under conditions inputted through said control panel.

2. The color copier of claim 1 wherein said control means also serves to control amounts of toner of different colors to be attached to form a copy of said original according to claim spectroscopic color data detected by said optical sensor means and said inputted conditions.

3. The color copier of claim 2 further comprising a photoreceptor control, said photoreceptor control including means for setting exposure of said photoreceptor to said reflected light.

4. The color copier of claim 3 wherein said control means further includes means for setting surface voltage of said photoreceptor.

5. The color copier of claim 4 further comprising developing means for developing a toner image on said photoreceptor, said control means including means for setting bias voltage of said developing means.

6. The color copier of claim 1 wherein said optical sensor means includes three spectroscopic sensors each having a color filter and having associated therewith an amplifier.

7. The color copier of claim 6 further comprising photo amplifiers being adjusted according to transmissivity characteristics of said filter and color sensitivity characteristics of said photoreceptor.

* * * * *